US008009108B2

(12) United States Patent
Eisenbeis et al.

(10) Patent No.: US 8,009,108 B2
(45) Date of Patent: Aug. 30, 2011

(54) ANTENNA APPARATUS FOR EXPLOSIVE ENVIRONMENTS

(75) Inventors: Clyde Thomas Eisenbeis, Marshalltown, IA (US); Scott R. Kratzer, Marshalltown, IA (US)

(73) Assignee: Fisher Controls International LLC, St. Louis, MO (US)

( * ) Notice: Subject to any disclaimer, the term of this patent is extended or adjusted under 35 U.S.C. 154(b) by 1139 days.

(21) Appl. No.: 11/804,189

(22) Filed: May 17, 2007

(65) Prior Publication Data

US 2010/0259461 A1 Oct. 14, 2010

(51) Int. Cl.
*H01Q 1/24* (2006.01)

(52) U.S. Cl. ..... 343/702; 343/872

(58) Field of Classification Search ..... 343/702, 343/700 MS, 841, 872, 873
See application file for complete search history.

(56) References Cited

U.S. PATENT DOCUMENTS 5,710,568 A * 1/1998 Shirazi et al. ..... 343/719
7,014,502 B2 * 3/2006 Rasmussen ..... 439/578
7,057,577 B1 6/2006 Willoughby et al.
7,639,187 B2 * 12/2009 Caballero et al. ..... 343/702
2004/0183744 A1 9/2004 Raiman
2004/0194994 A1 10/2004 Rasmussen
2005/0001773 A1 * 1/2005 Morningstar et al. ..... 343/702

OTHER PUBLICATIONS

International Searching Authority, International Search Report of International Application No.: PCT/US2008/063077, Jul. 30, 2008, 3 pages.
International Searching Authority, Written Opinion of International Application No.: PCT/US2008/063077, Jul. 30, 2008, 6 pages.
European Patent Office, Communication Pursuant to Article 94(3) EPC issued for corresponding Application No. 08 747 860.8—1248 dated Feb. 18, 2011.

* cited by examiner

*Primary Examiner* — Tan Ho
(74) *Attorney, Agent, or Firm* — Hanley, Flight & Zimmerman, LLC.

(57) ABSTRACT

Antenna assemblies for wireless communications in explosive environments are described. An example antenna assembly has a housing, a base member at one end of the housing, and an antenna extending through the base member and into the housing. A sealing compound within the base member encapsulates the antenna to seal the antenna at the base member.

18 Claims, 5 Drawing Sheets

ANTENNA APPARATUS FOR EXPLOSIVE ENVIRONMENTS

FIELD OF THE DISCLOSURE

This disclosure relates generally to antenna apparatus for wireless communications in explosive environments and, more particularly, to antenna apparatus having an end encapsulated at a base member of a housing.

BACKGROUND

Facilities for the manufacture, storage, transportation or use of flammable materials such as, for example, hydrocarbons are hazardous environments due to the possibility of an accidental ignition by a flame or a spark in the environment. Therefore, regulations and standards to minimize the possibility of fires or explosions govern the construction of buildings and the use of equipment such as, for example, explosion-proof equipment, in such hazardous environments. The regulations and standards include sealing and/or restriction requirements so that hazardous gases cannot reach an electric arc or spark cannot ignite a fire or explosion in the hazardous environment. The term "explosion-proof" is used to mean a designated piece of equipment or structure will not permit an ignition source such as a spark or flame to propagate to the atmosphere and, if an explosion does occur within the equipment or structure, the explosion will be safely contained within an enclosure and pressure from the explosion will be safely relieved.

Explosion-proof antenna assemblies are used to transmit and/or receive wireless communications in hazardous environments. The antenna may be contained or housed within a radome to isolate the antenna from the surrounding hazardous environment. Typically, the antenna is connected to a conductive wire or cable that extends through an enclosure or fitting at an end of the radome. The enclosure must provide a flame-tight engagement with the wire or cable and the radome so that a spark or explosion cannot exit the radome.

SUMMARY

An antenna assembly for use in an explosive environment comprises a housing, a base member at one end of the housing, an antenna extending though the base member and into the housing, and a sealing compound within the base member and the antenna extending into and through the sealing compound, the sealing compound encapsulating the antenna to seal the antenna at the base member.

DETAILED DESCRIPTION

In general, the example antenna assemblies for wireless communications in explosive environments described herein may be utilized for communications by various types of devices and in various environments. Additionally, while the examples disclosed herein are described in connection with explosion-proof wireless communications in explosive environments such as the hydrocarbon processing industry, the examples described herein may be more generally applicable to a variety of communications for different purposes.

Figure 1:
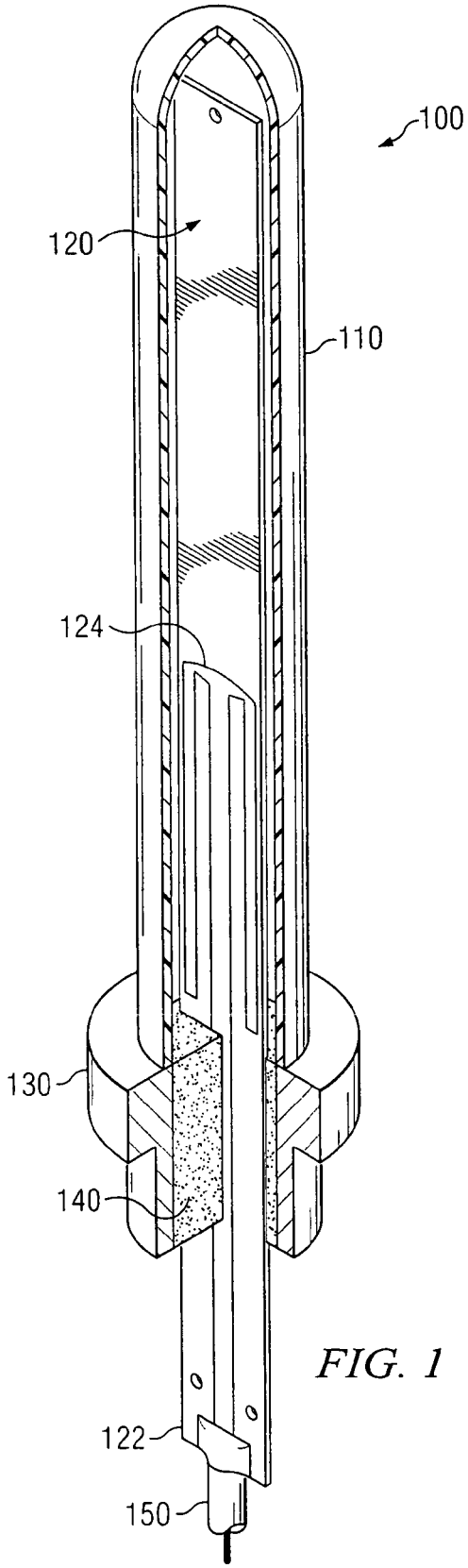
FIG. 1 is a partially cut-away schematic illustration of an example antenna assembly for use in an explosive environment.

FIG. 1 is a partially cut-away schematic illustration of an example antenna assembly 100 for use in an explosive environment. The example antenna assembly 100 includes a radome or housing 110 typically made of a plastic material such as, for example, Noryl® from General Electric Company of Schenectady, N.Y., a printed circuit board antenna 120, a metal base member or enclosure 130, a sealing compound or explosion-proof encapsulant material 140 located within the base member 130, and a coaxial cable 150 connected to the antenna 120. The sealing compound 140 may comprise any of numerous potting compounds such as, for example, Stycast® epoxy resins from Emerson & Cuming, Inc. of Canton, Mass.

The coaxial cable 150 may be connected to other circuitry or electrical components for the example antenna assembly 100 such as, for example, an integrated circuit (not shown). The housing 110 may be attached to the base member 130 by any of numerous types of connections such as, for example, threaded, snap-fit, press-fit, and/or adhesive connections. The antenna 120 extends from an antenna end 122 located outside of the antenna assembly 100, through the base member 130 and into the housing 110. The coaxial cable 150 is connected, for example, by solder to a circuit 124 printed on the antenna 120. The antenna 120 is encapsulated within the sealing compound 140 at the end member 130 to position and maintain the antenna 120 within the housing 110. As clearly shown in FIG. 1, the antenna 120 extends into and through both the end member 130 and the sealing compound 140.

The example antenna assembly 100 shown in FIG. 1 provides a low cost explosion-proof antenna assembly. Antennas, particularly high frequency antennas, which are connected to a non-coaxial conductive wire, are typically subject to undesirable impedance changes caused by the different types of materials of the wire, an end member, and an antenna. To maintain proper control of antenna impedance for impedance matching, coaxial cable is generally used. Additionally, when a conductive wire or a coaxial cable extends through a sealing material to the antenna, the conductive wire or coaxial cable typically has its outer insulation removed or stripped off to prevent any flame from passing between the outer insulation and the inner wire or cable. However, the example antenna assembly 100 includes a printed circuit board antenna 120 that extends through the end member 130 and the sealing compound 140 to the antenna end 122 where the coaxial cable 150 is connected. By extending the printed circuit board antenna 120 into and through the sealing compound 140 contained within the end member 130, the antenna assembly 100 provides a flame-tight seal between the antenna 120, the sealing compound 140, and the end member 130, eliminates the need to remove insulation from a conductive wire or coaxial cable extending though an end member and a sealing material, and significantly reduces impedance changes.

Figure 2:
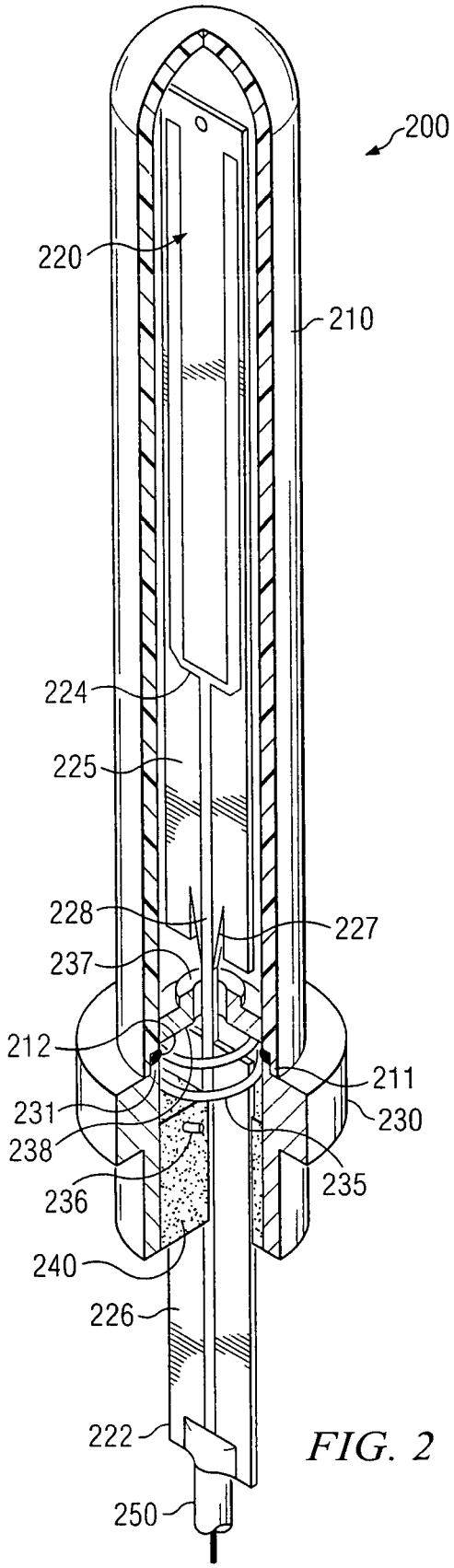
FIG. 2 is a partially cut-away schematic illustration of another example antenna assembly for use in an explosive environment.

FIG. 2 is a partially cut-away schematic illustration of another example antenna assembly 200 for use in an explosive environment. The example antenna assembly 200 includes a radome or housing 210 typically made of a plastic material, a printed circuit board antenna 220 including an upper antenna portion 225 and a lower antenna portion 226, a metal base member or enclosure 230 having a flange 231, a flexible coil spring or resilient member 235 located within the base member 230 and about the lower antenna portion 226 of the antenna 220, an antenna base member 237, a sealing compound or explosion-proof encapsulant material 240 located within the base member 230, and a coaxial cable 250 connected to the antenna 220. The coaxial cable 250 may be connected to other circuitry or electrical components for the example antenna assembly 200 such as, for example, an integrated circuit (not shown).

In the present example antenna assembly 200, the housing 210 is preferably attached or bonded to the antenna base member 237 by any of numerous types of connections such as, for example, threaded, snap-fit, press-fit, and/or adhesive connections. The housing 210 has a housing end 211 loosely coupled to the base member 230 by, for example, an overlapping fit as illustrated in FIG. 2 at the housing end 211 and the flange 231 of the end member 230, and including a seal 212, such as, for example, an O-ring seal, between the housing end 211 and the flange 231, to enable movement of the housing 210 relative to the base member 230.

The antenna 220 extends from an antenna end 222 at the lower antenna portion 226 located outside of the example antenna assembly 200, through the base member 230, the sealing compound 240, and the resilient member 235, to a narrow-width antenna segment 227 supporting a flex circuit 228, and the upper antenna portion 225 in the housing 210. The coaxial cable 250 is connected, for example, by solder to a circuit 224 printed on antenna 220. The lower antenna portion 226 is encapsulated within the sealing compound 240 at the end member 230 to position the antenna 220 within the housing 210.

The example antenna assembly 200 provides an enhanced flexibility of the antenna 220 within the housing 210. A first end 236 of the resilient member 235 is received within the sealing compound 240 at the end member 230 to position the resilient member 235 relative to the end member 230. The resilient member 235 extends upwardly to an upper end 238 located slightly within the housing 210 and attached to the antenna base member 237. The resilient member 235 flexibly couples the antenna base member 237 and the housing 210 to the end member 230. The narrow-width antenna segment 227 supports the flex circuit 228 and connects the lower antenna portion 226 to the upper antenna portion 225. The antenna segment 227 is made of a flexible material such as, for example, a Kapton® polyimide flexible substrate and supports the flex circuit 228 that is connected to the circuit 224. The resilient member 235, the antenna segment 227, and the flex circuit 228 enable movement of the upper antenna portion 225 of the antenna 220 relative to the lower antenna portion 226.

The example antenna assembly 200 shown in FIG. 2 also provides a low cost explosion-proof antenna assembly. The lower antenna portion 226 of the printed circuit board antenna 220 extends into and through both the end member 230 and the sealing compound 240 to the antenna end 222 where the coaxial cable 250 is connected. As previously described above for the antenna assembly 100 of FIG. 1, the antenna assembly 200 also accomplishes a flame-tight seal between the antenna 220, the sealing compound 240 and the end member 230, eliminates the need to remove of insulation from a conductive wire or coaxial cable that extends though known end members and sealing materials to an area outside of the housing, and significantly reduces impedance changes. Additionally, the use of the resilient member 235, the narrow-width antenna segment 227 and the flex circuit 228 enables increased flexibility of the upper antenna portion 225 in the housing 210. The increased flexibility of the upper antenna portion 225 enables the antenna assembly 200 to better withstand the effects of an explosion within the housing 210 and/or impacts or other shocks to the housing 210, the end member 230, the antenna end 222, and/or the coaxial cable 250.

Figure 3:
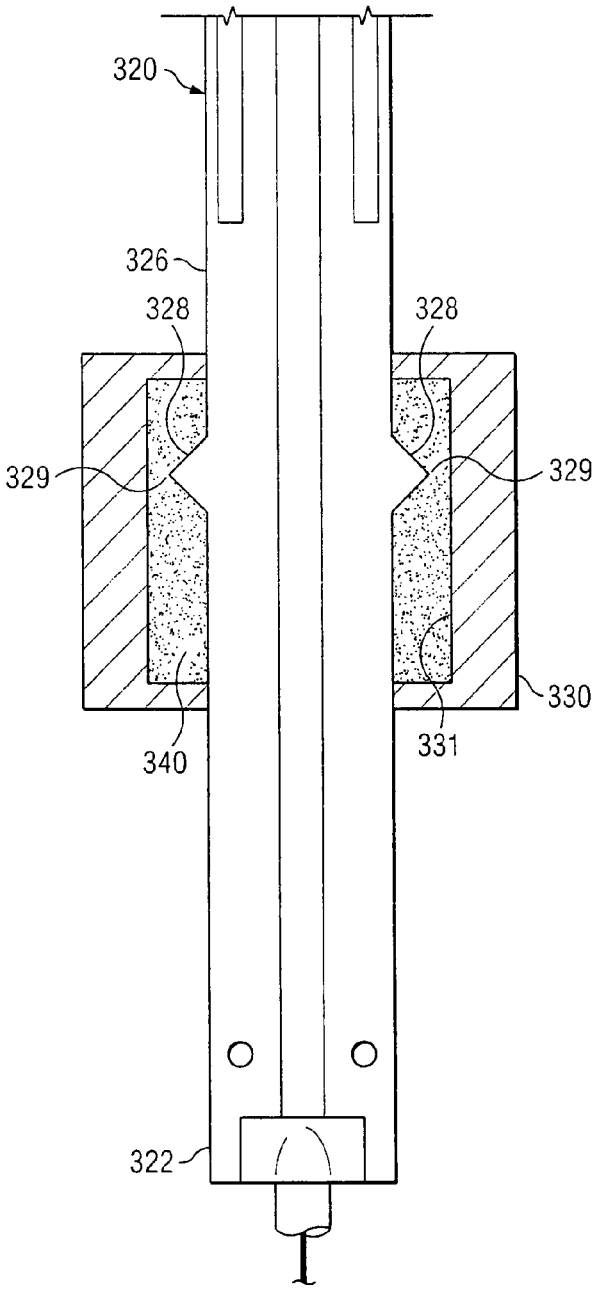
FIG. 3 is a partial schematic illustration of an example antenna encapsulated in a sealing compound at a base member.

FIG. 3 is a partial schematic illustration of an example antenna 320 encapsulated in a sealing compound 340. Although only partially illustrated in FIG. 3, the example antenna 320 may include all or part of the structural elements or parts of the other antenna assemblies described herein. The antenna 320 extends from a lower antenna portion 326 to an antenna end 322. A metal end member 330 and a sealing compound or explosion-proof encapsulant 340 are located between the lower antenna portion 326 and the antenna end 322. The example antenna 320 extends into and through both the schematically illustrated metal end member 330 and the sealing compound 340. It should be appreciated by one of ordinary skill in the art that the sealing compound 340 may be retained by various methods including roughening or texturing an inner surface 331 of the metal end member 330 such that the sealing compound 340 may adhesively or structural bind to the metal end member 330. Additionally, the example antenna 320 includes one or more projections or lateral protrusions or extensions 328 extending to points 329 to assist in anchoring or attaching the example antenna 320 within the metal end member 330 and the sealing compound 340. Although illustrated as a pair of oppositely disposed projections or lateral protrusions or extensions 328, each extending to a point 329, the lateral protrusions or extensions 328 may have numerous shapes and forms such as, for example, part of a rectangle, square, circle, oval, irregular pattern, diverging segment ends, etc. and may be located, in alignment or non-alignment, on one or both sides of the example antenna 320. The presence of one or more of the lateral protrusions or extensions 328 improves the fixed positioning of the example antenna 320 within the metal end member 330 and the sealing compound 340.

Figure 4:
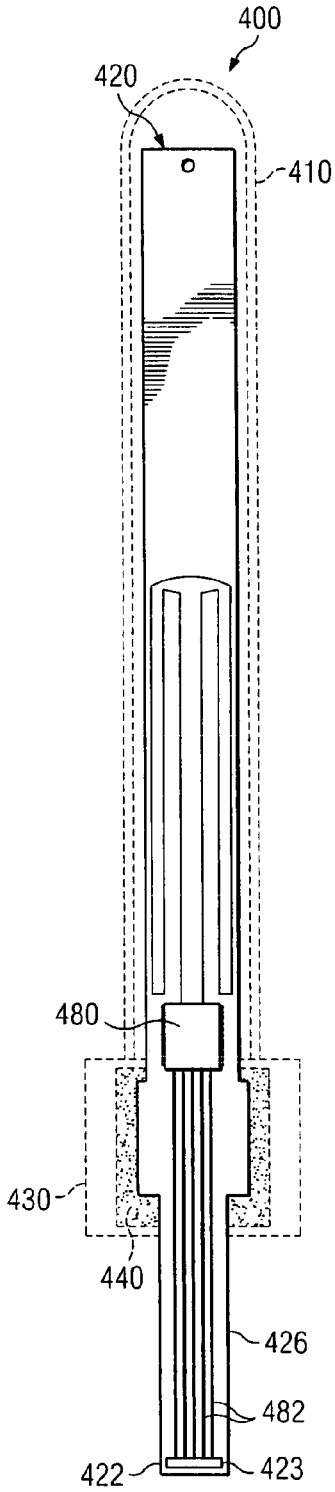
FIG. 4 is a schematic illustration of another example antenna assembly having an antenna with an integrated circuit mounted thereon, for use in an explosive environment.

FIG. 4 is a schematic illustration of another example antenna assembly 400 having an antenna 420 with an electrical component such as an integrated circuit 480 mounted thereon. The example antenna 420 may be contained within a radome or housing 410, an end member 430 and a sealing compound or explosion-proof encapsulant 440, shown as dashed lines. Referring to the description of FIGS. 1 and 2, the coaxial cables 150 and 250 are each attached at one end to the antenna ends 122 and 222 of the antennas 120 and 220, respectively, and are each connected at the other end to other electrical systems, subsystems, or components such as, for example, a micro-chip, a microprocessor, an integrated circuit, etc. However, as shown in FIG. 4 selected electrical systems, subsystems, or components may be mounted or attached to the antenna 420. For example, FIG. 4 illustrates an electrical component such as the integrated circuit 480 mounted or attached to a lower antenna portion 426 of the antenna 420. The lower antenna portion 426 includes one or more conductive paths 482 extending between electrical connection(s) with the integrated circuit 480 and a connector 423 at an antenna end 422 to provide an electrical connection and communication between the integrated circuit 480 and other electrical systems, subsystems, or components.

Figure 5:
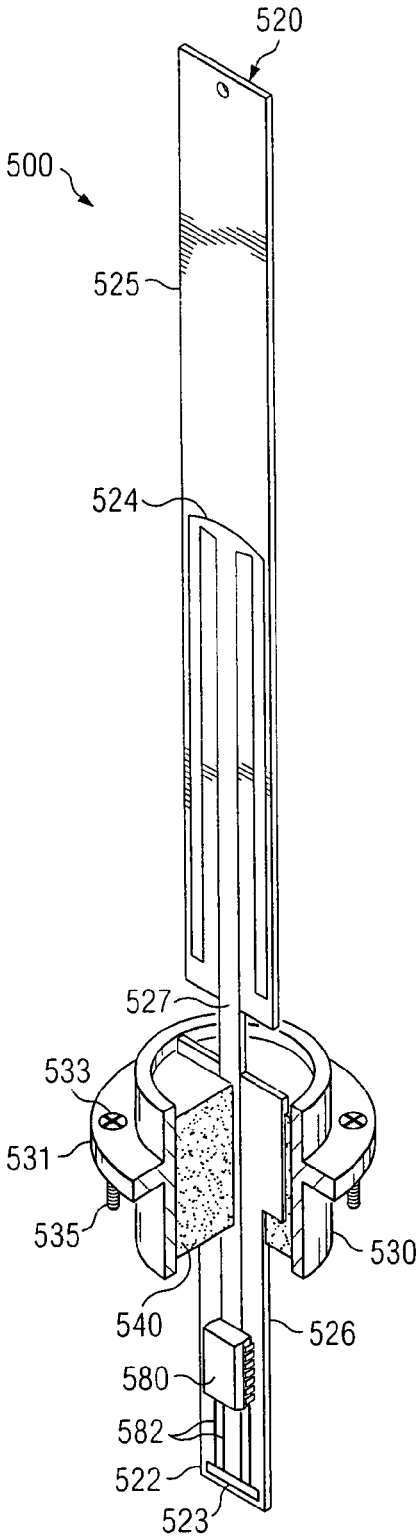
FIG. 5 is a partial schematic illustration of another example antenna assembly for use in an explosive environment.

FIG. 5 is a partial schematic illustration of another example antenna assembly 500 for use in an explosive environment. The example antenna assembly 500 includes a radome or housing (not shown) connected to an end member 530, in a manner similar to that disclosed above for the other examples. The housing is not illustrated so that printed circuit board antenna 520 may be seen more clearly. The example antenna assembly 500 includes the antenna 520, an electrical component or device such as, for example, an integrated circuit 580, one or more conductive paths 582 on the antenna 520, a connector 523, a metal base member or enclosure 530, and a sealing compound or explosion-proof encapsulant material 540 located within the base member 530. The antenna 520 is encapsulated within the sealing compound 540 at the end member 530 to position and maintain a lower antenna portion 526 within the end member 530. The end member 530 includes a flange 531 having one or more openings 533, each of which may receiver a fastener 535 such as, for example, a screw, bolt, rivet, etc. The antenna 520 includes an antenna end 522 at the lower antenna portion 526 located outside of the end member 530 and extends into and through the base member 530 and the sealing compound 540. The lower antenna portion 526 is connected to an upper antenna portion 525 by a narrow-width antenna segment 527. An antenna circuit 524 is supported on the upper antenna portion 525. The connector 523 at the antenna end 522 provides an electrical connection and communication between the antenna 520 and other electrical systems, subsystems or components.

The example antenna assembly 500 provides an increased flexibility of the antenna 520 within its housing (not shown). In particular, the narrow-width antenna segment 527 is more flexible than the larger-width lower antenna portion 526 and the upper antenna portion 525 and, thus, enables movement of the upper antenna portion 525 relative to its housing.

The example antenna assembly 500 shown in FIG. 5 provides a low cost explosion-proof antenna assembly. The printed circuit board antenna 520 extends through the end member 530 and the sealing compound 540 to the antenna end 522 and the connector 523. The example antenna assembly 500 provides a flame-tight seal between the antenna 520, the sealing compound 540 and the end member 530, eliminates the need to remove insulation from a conductive wire or coaxial cable that extends though known end members and sealing materials to an area outside of the housing, and significantly reduces impedance changes. Additionally, the use of the narrow-width antenna segment 527 further improves the flexibility of the upper portion 525 of the antenna 520. The increased flexibility of the upper portion 525 enables the example antenna assembly 500 to better withstand impacts or other shocks to the housing and/or the end member 530.

Figure 6:
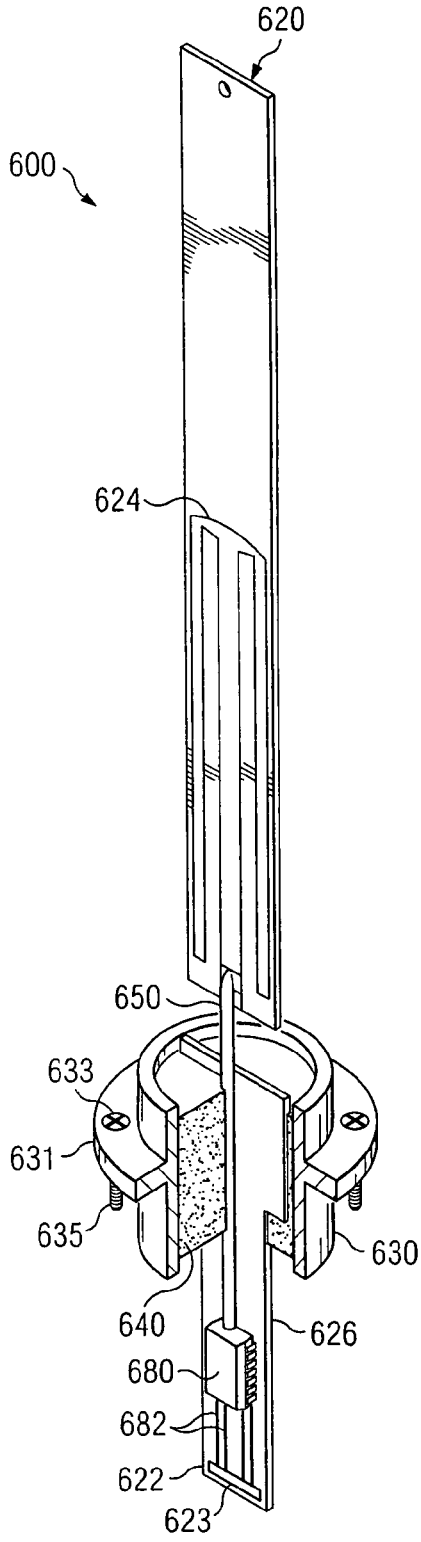
FIG. 6 is a partial schematic illustration of another example antenna assembly for use in an explosive environment.

FIG. 6 is a partial schematic illustration of another example antenna assembly 600 for use in an explosive environment. The example antenna assembly 600 includes a radome or housing (not shown) connected to an end member 630, in a manner similar to that described herein for the other examples. In FIG. 6, the housing is again not illustrated so that printed circuit board antenna 620 may be seen more clearly. The example antenna assembly 600 includes the antenna 620 mounted in the housing (not shown), a coaxial cable 650 extending between a circuit 624 on the antenna 620 and an electrical component or device such as, for example, an integrated circuit 680 on a lower platform 626, one or more conductive paths 682 on the lower platform 626 extending to a connector 623 at a lower platform end 622, a metal base member or enclosure 630, and a sealing compound or explosion-proof encapsulant material 640 located within the base member 630. The lower platform 626 is encapsulated within the sealing compound 640 at the end member 630 to position and maintain the lower platform 626 within the end member 630. The end member 630 includes a flange 631 having one or more openings 633, each of which may receive a fastener 635 such as, for example, a screw, bolt, rivet, etc. The lower platform 626 extends from the platform end 622 located outside of the end member 630, into and through the base member 630 and the sealing compound 640. The connector 623 at the platform end 622 provides an electrical connection and communication between the integrated circuit 680 and other electrical systems, subsystems or components.

The example antenna assembly 600 also provides flexibility of the antenna 620 within the its housing (not shown). The coaxial cable 650 provides flexibility between the lower platform 626 and the antenna 620 to enable movement of the antenna 620 relative to the lower platform 626, which is fixed in position within the end member 630 and the sealing compound 640. Alternatively, the coaxial cable 650 may be a flexible electrical wire to connect the integrated circuit 680 to the circuit 624 on the antenna 620.

The example antenna assembly 600 shown in FIG. 6 also provides another low cost explosion-proof antenna assembly. The lower platform 626 extends through the end member 630 and the sealing compound 640 to the lower platform end 622 and the connector 623. The example antenna assembly 600 provides a flame-tight seal between the lower platform 626, the sealing compound 640 and the end member 630, and eliminates the need to remove insulation from a conductive wire or coaxial cable that extends through known end members and sealing materials to an area outside of the housing. Additionally, the flexibility of the antenna 620 enables the example antenna assembly 600 to better withstand impacts or other shocks to the housing and/or the end member 630.

Figure 7:
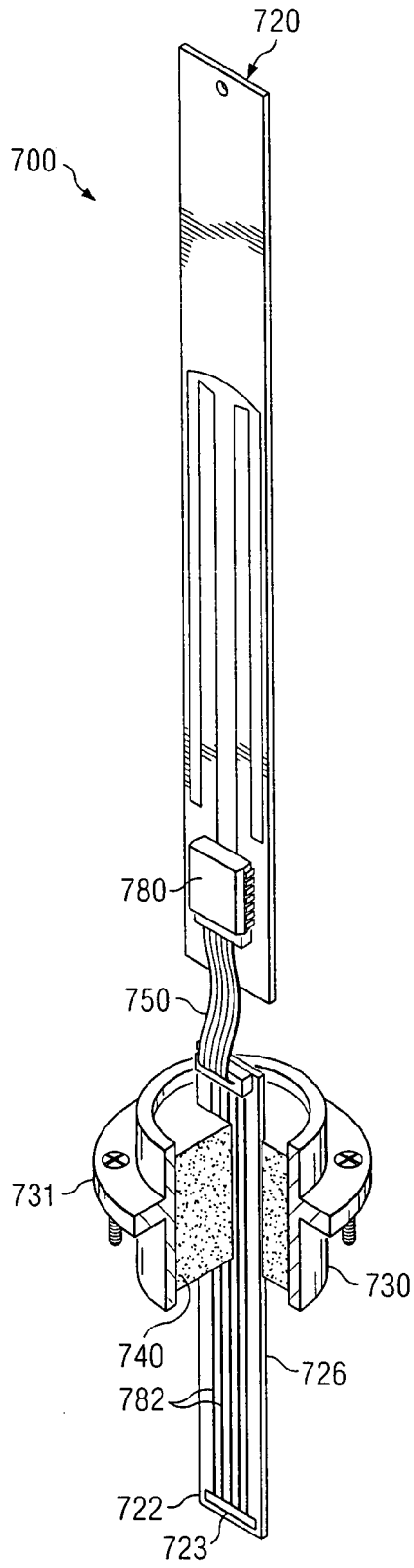
FIG. 7 is a partial schematic illustration of yet another example antenna assembly for use in an explosive environment.

FIG. 7 is a partial schematic illustration of yet another example antenna assembly 700 for use in an explosive environment. The example antenna 700 includes a radome or housing (not shown) connected to an end member 730, in a manner similar to that described herein for the other examples. The example antenna assembly 700 includes an antenna 720 mounted in the housing (not shown), a flat ribbon cable 750 extending between an electrical component or device such as, for example, an integrated circuit 780 on the antenna 720 and one or more conductive paths 782 on a lower platform 726, a connector 723 at a lower platform end 722, a metal base member or enclosure 730, and a sealing compound or explosion-proof encapsulant material 740 located within the base member 730. As similarly described in connection with the example antenna assembly 600 of FIG. 6, in FIG. 7 the lower platform 726 is encapsulated within the sealing compound 740 at the end member 730 to position and maintain the lower platform 726 within the end member 730. The end member 730 includes a flange 731, which may have one or more openings (not shown) each to receive a fastener such as, for example, a screw, bolt, rivet, etc. The lower platform 726 extends from the platform end 722 located outside of the end member 730, into and through the base member 730 and the sealing compound 740. The connector 723 at the platform end 722 provides an electrical connection and communication between the antenna 670 and other electronic systems or subsystems. The flat ribbon cable 750 may flex to enable movement of the antenna 720 relative to the lower platform 726, which is fixed in position within the end member 730 and the sealing compound 740.

The example antenna assembly 700 shown in FIG. 7 provides yet another low cost explosion-proof antenna assembly. The lower platform 726 extends through the end member 730 and the sealing compound 740 to the lower platform end 722 and the connector 723. The example antenna assembly 700 provides a flame-tight seal between the lower platform 726, the sealing compound 740 and the end member 730, and eliminates the need to remove insulation from a conductive wire or coaxial cable that extends through known end members and sealing materials to an area outside of the housing. Additionally, the use of the flat ribbon cable 750 improves the flexibility of the antenna 720 within its housing. The increased flexibility of the antenna 720 enables the example antenna assembly 700 to better withstand the effects of an explosion within the its housing and/or impacts or other shocks to the housing, the end member 730, the lower platform end 722, or the connector 723.

Although certain example antennas have been described herein, the scope of coverage of this patent is not limited thereto. On the contrary, this patent covers all methods, apparatus and articles of manufacture fairly falling within the scope of the appended claims either literally or under the doctrine of equivalents. For example, one of ordinary skill in the art should appreciate that the flex circuit described herein may also be a narrowed portion of the antenna, which may provide flexure and structural compliance substantially similar to a flex circuit. Additionally, the integrated circuit may be positioned within the sealing compound or positioned above or below the metal end member, as illustrated, without departing from the spirit and scope of the disclosure.

What is claimed is:

1. An antenna assembly for use in an explosive environment, comprising:

a housing;

a base end member and an antenna base member at one end of the housing;

an antenna extending though the base end member and into the housing;

a sealing compound within the base end member and the antenna extending into and through the sealing compound, the sealing compound encapsulating the antenna to seal the antenna at the base end member; and a resilient member located at the base end member and having one end secured by the sealing compound and another end at the antenna base member which engages the housing, to flexibly couple the antenna and the housing to the base end member.

2. The antenna assembly as defined in claim 1, wherein the antenna comprises a printed circuit board.

3. The antenna assembly defined in claim 1, wherein a coaxial cable is coupled to an end of the antenna located outside the base end member.

4. The antenna assembly as defined in claim 1, wherein the antenna includes a segment having a narrow width, and wherein a flex circuit is disposed on the segment.

5. The antenna assembly as defined in claim 1, wherein the one end of the resilient member is a least partially encapsulated by the sealing compound.

6. The antenna assembly as defined in claim 1, further comprising an electrical component on the antenna, the electrical component connected with conductive paths on the antenna.

7. The antenna assembly as defined in claim 1, wherein the antenna includes a segment having a narrow width, and wherein the segment is disposed adjacent the base end member to provide flexibility of the antenna beyond the segment and within the housing.

8. An antenna assembly for use in an explosive environment, comprising:

a housing;

a base end member at one end of the housing;

an antenna extending though the base end member and into the housing; and a sealing compound within the base end member and the antenna extending into and through the sealing compound, the sealing compound encapsulating the antenna to seal the antenna at the base end member, wherein the antenna includes at least one lateral antenna protrusion adjacent the base end member to fix the antenna within the sealing compound.

9. The antenna assembly as defined in claim 8, wherein the antenna includes at least one lateral protrusion on each side of the antenna.

10. The antenna assembly as defined in claim 8, wherein the lateral protrusion has the shape of at least part of a rectangle, square, oval, circle, irregular pattern, or diverging ends.

11. An antenna assembly for use in an explosive environment, comprising:

a housing having a longitudinally extending axis;

a base end member at one end of the housing;

a platform extending though the base end member to at least the housing and parallel to the longitudinally extending axis of the housing, the platform having at least one conductive path;

an antenna within the housing;

an electrical connection between the conductive path and the antenna; and a sealing compound within the base end member and the platform extending into and through the sealing compound, the sealing compound encapsulating the platform to seal the platform at the base end member.

12. The antenna assembly as defined in claim 11, further comprising an electrical component on the platform and electrically connected to the conductive path.

13. The antenna assembly as defined in claim 12, wherein the electrical connection is at least one of a coaxial cable or a flexible electrical wire.

14. The antenna assembly as defined in claim 11, further comprising an electrical component on the antenna and connected to the electrical connection.

15. The antenna assembly as defined in claim 14, where in the electrical connection comprises a flexible ribbon cable

16. The antenna assembly as defined in claim 11, wherein the antenna comprises a printed circuit board.

17. The antenna assembly as defined in claim 11, further comprising a connector connected with the conductive path at an end of the platform.

18. The antenna assembly as defined in claim 11, wherein the base end member includes an extension to enable attachment of the base end member to another object.

* * * * *